US010121336B2

(12) United States Patent
Burmeister, II

(10) Patent No.: US 10,121,336 B2
(45) **Date of Patent: *Nov. 6, 2018**

(54) MERCHANDISE SECURITY SYSTEM WITH SOUND CHAMBER

(71) Applicant: InVue Security Products Inc., Charlotte, NC (US)

(72) Inventor: Kirk Burmeister, II, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/002,450

(22) Filed: Jun. 7, 2018

(65) Prior Publication Data

US 2018/0286197 A1 Oct. 4, 2018

Related U.S. Application Data

(63) Continuation of application No. 15/353,136, filed on Nov. 16, 2016, now Pat. No. 10,008,082.

(60) Provisional application No. 62/257,804, filed on Nov. 20, 2015.

(51) Int. Cl.
*G08B 13/14* (2006.01)
*G08B 3/10* (2006.01)

(52) U.S. Cl.
CPC ..... *G08B 13/1463* (2013.01); *G08B 3/10* (2013.01)

(58) Field of Classification Search
CPC ..... G08B 13/1463; G08B 3/10
See application file for complete search history.

(56) References Cited

U.S. PATENT DOCUMENTS

| | | | | |
|---|---|---|---|---|
| 6,380,855 | B1 | 4/2002 | Ott | |
| 7,385,522 | B2 | 6/2008 | Belden, Jr. et al. | |
| 7,629,895 | B2 | 12/2009 | Belden, Jr. et al. | |
| 2002/0014368 | A1 * | 2/2002 | Adamson | G10K 11/22 181/182 |
| 2005/0073413 | A1 * | 4/2005 | Sedon | A47F 7/024 340/568.8 |
| 2007/0262876 | A1 * | 11/2007 | Marsilio | E05B 73/0023 340/572.8 |
| 2008/0168806 | A1 | 7/2008 | Belden et al. | |
| 2012/0019383 | A1 | 1/2012 | Fawcett et al. | |

(Continued)

OTHER PUBLICATIONS

"Design of a Helmholtz Chamber," <http://www.puiaudio.com/resources-white-papers-helmholtz.aspx> PUI Audio, Dayton, OH, Jun. 6, 2013 (4 pages).

*Primary Examiner* — Sisay Yacob
(74) *Attorney, Agent, or Firm* — InVue Security Products Inc.

(57) ABSTRACT

Embodiments of the present invention are directed to security systems for securing an item of merchandise from theft or unauthorized removal. For example, the security system may include a sensor configured to be coupled to the item of merchandise and a base configured to removably support the sensor and the item of merchandise thereon. The base includes a sidewall and a bottom surface, and the sidewall defines an opening. The security system also includes an alarm configured to generate sound in response to a security event. The alarm includes a sound chamber configured to direct sound exiting the sound chamber towards the opening in the sidewall.

20 Claims, 9 Drawing Sheets

(56) References Cited

U.S. PATENT DOCUMENTS

| | | | | |
|---|---|---|---|---|
| 2012/0151974 | A1* | 6/2012 | Zhang | E05B 73/0041 70/63 |
| 2017/0148289 | A1 | 5/2017 | Burmeister, II | |

* cited by examiner

MERCHANDISE SECURITY SYSTEM WITH SOUND CHAMBER

CROSS REFERENCE TO RELATED APPLICATIONS

This application is a continuation of and claims priority to U.S. application Ser. No. 15/353,136, filed Nov. 16, 2016, which is a nonprovisional of and claims the benefit of priority to U.S. Provisional Application No. 62/257,804 filed on Nov. 20, 2015, the entire disclosures of which are incorporated herein by reference.

BACKGROUND OF THE INVENTION

Embodiments of the present invention relate generally to security systems for protecting items of merchandise, such as consumer electronics products.

It is common practice for retailers to provide demonstration models of relatively expensive consumer electronics products, such as handheld devices, tablets, and laptop computers, so that a potential purchaser may examine the product more closely and test the operation of its features. A working demonstration model, however, increases the possibility that the demonstration model will be stolen or removed from the display area by an unauthorized person. As a result, demonstration models of consumer electronics products are typically protected by a security system that permits a potential purchaser to examine and operate the product, while reducing the likelihood that the demonstration model will be stolen or removed from the display area.

The security system displays an item of merchandise so that a potential purchaser can readily view and, in some instances, operate the item when making a decision whether to purchase the item. At the same time, the item of merchandise is usually physically secured on the security system so as to prevent, or at least deter, theft of the item. The merchandise display security system may also include an alarm that is activated to alert store personnel in the event that a shoplifter attempts to separate the item of merchandise from the security system.

BRIEF SUMMARY

Embodiments of the present invention are directed towards security systems, bases, alarms, sound chambers, and methods for securing an item of merchandise. In one embodiment, a security system includes a sensor configured to be coupled to the item of merchandise and a base configured to removably support the sensor and the item of merchandise thereon. The base includes a sidewall and a bottom surface, wherein the sidewall defines an opening. The security system also includes an alarm configured to generate sound in response to a security event. The alarm includes a sound chamber configured to direct sound exiting the sound chamber towards the opening in the sidewall.

In another embodiment, a security system includes a base configured to removably support the sensor and the item of merchandise thereon. The security system further includes a wedge-shaped sound chamber configured to generate sound in response to a security event.

According to one embodiment, a base for a merchandise security system includes a housing configured to removably support an item of merchandise thereon. The housing includes a sidewall and a bottom surface, wherein the sidewall defines an opening. The security system also includes an alarm disposed within the housing and configured to generate sound in response to a security event. The alarm includes a sound chamber configured to direct sound exiting the sound chamber towards the opening in the sidewall.

In one embodiment, a sound chamber for a merchandise security system includes a chamber comprising an opening and a cap coupled to the chamber and configured to resonate for generating sound. The cap is disposed an acute angle relative to a bottom surface of the chamber, and sound generated by the cap is configured to exit the opening.

In another embodiment, a sound chamber includes a first chamber comprising a first opening and a second chamber comprising a second opening. The sound chamber also includes a cap coupled between the first chamber and the second chamber. The cap is configured to resonate for generating sound, and sound generated by the cap is configured to exit each of the first opening and the second opening.

In one embodiment, a method for securing an item of merchandise is provided. The method includes generating sound with a sound chamber in response to a security event and directing the sound exiting the sound chamber towards an opening defined in a sidewall of a base housing the sound chamber.

DETAILED DESCRIPTION OF EMBODIMENTS OF THE INVENTION

Figure 1:
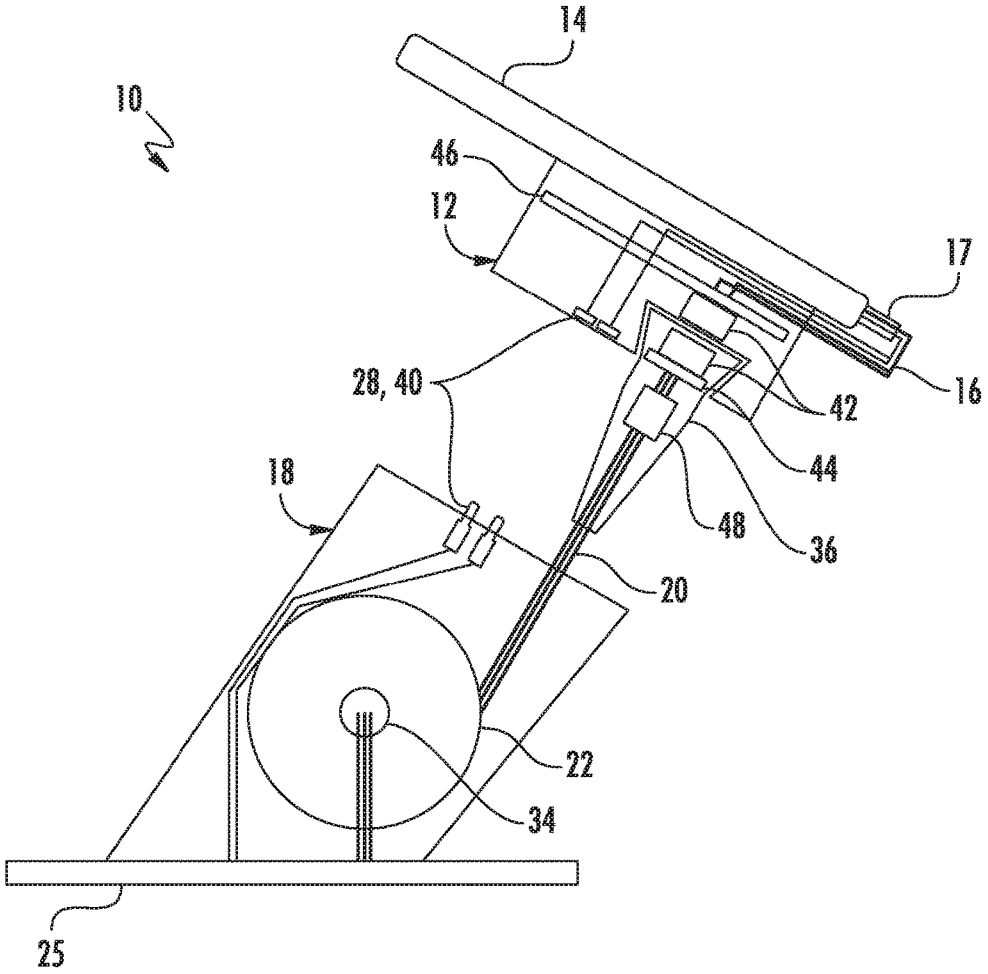
FIG. 1 illustrates a schematic of a security system according to one embodiment of the present invention.

Referring to the accompanying figures wherein identical reference numerals denote the same elements throughout the various views, embodiments of security systems according to the present invention for protecting an item of merchandise against theft or unauthorized removal are disclosed. The item of merchandise may be any item, including any number of consumer electronics products (e.g. hand-held device, cellular phone, smart phone, tablet, laptop computer, etc.).

The security systems described herein are operable for securing the item of merchandise against theft or authorized removal, while at the same time permitting a potential purchaser to closely examine and operate the item of merchandise in a display area. The security system permits a potential purchaser to examine and test the item of merchandise, while reducing the likelihood that the item of merchandise will be stolen or removed from the display area by an unauthorized person. The systems shown and described herein are suitable for securing an item of merchandise in a residential or commercial environment, as well as a retail environment, and furthermore, is not intended to be limited to use only as a security display device for protecting against theft and/or unauthorized removal.

According to one embodiment shown in FIG. 1, the security system 10 generally comprises a sensor 12 configured to be secured to an item of merchandise. The sensor 12 may be electrically connected to a connector 17 that is configured to electrically connect to an input jack of the item of merchandise 14. The security system 10 may also include a base 18 that is configured to removably support the sensor 12 and the item of merchandise 14 thereon. The base 18 generally comprises a housing that may contain a variety of components. In some embodiments, the base 18 and the sensor 12 include one or more contacts 28, 40 for facilitating contact charging when the sensor is supported on the base. In addition, the security system 10 also includes a cable 20 that is coupled to the sensor 12 at one end and operably engaged with a recoiler 22 at an opposite end. As explained in further detail below, a sense circuit or loop and/or a charging circuit or loop may be defined through the base 18, the cable 20, and/or the sensor 12. As such, the sense loop may be used to detect various security events associated with the sensor 10 and/or cable 20, such as the cable being cut, shorted, and/or disconnected. The charging circuit allows for charging of the item of merchandise 14 and/or a power source carried by the sensor 12 and/or the base 18. The sensor 12 may also be used to detect security events associated with the sensor and/or the item of merchandise 14, such as the item of merchandise being removed from the sensor.

Figure 2:
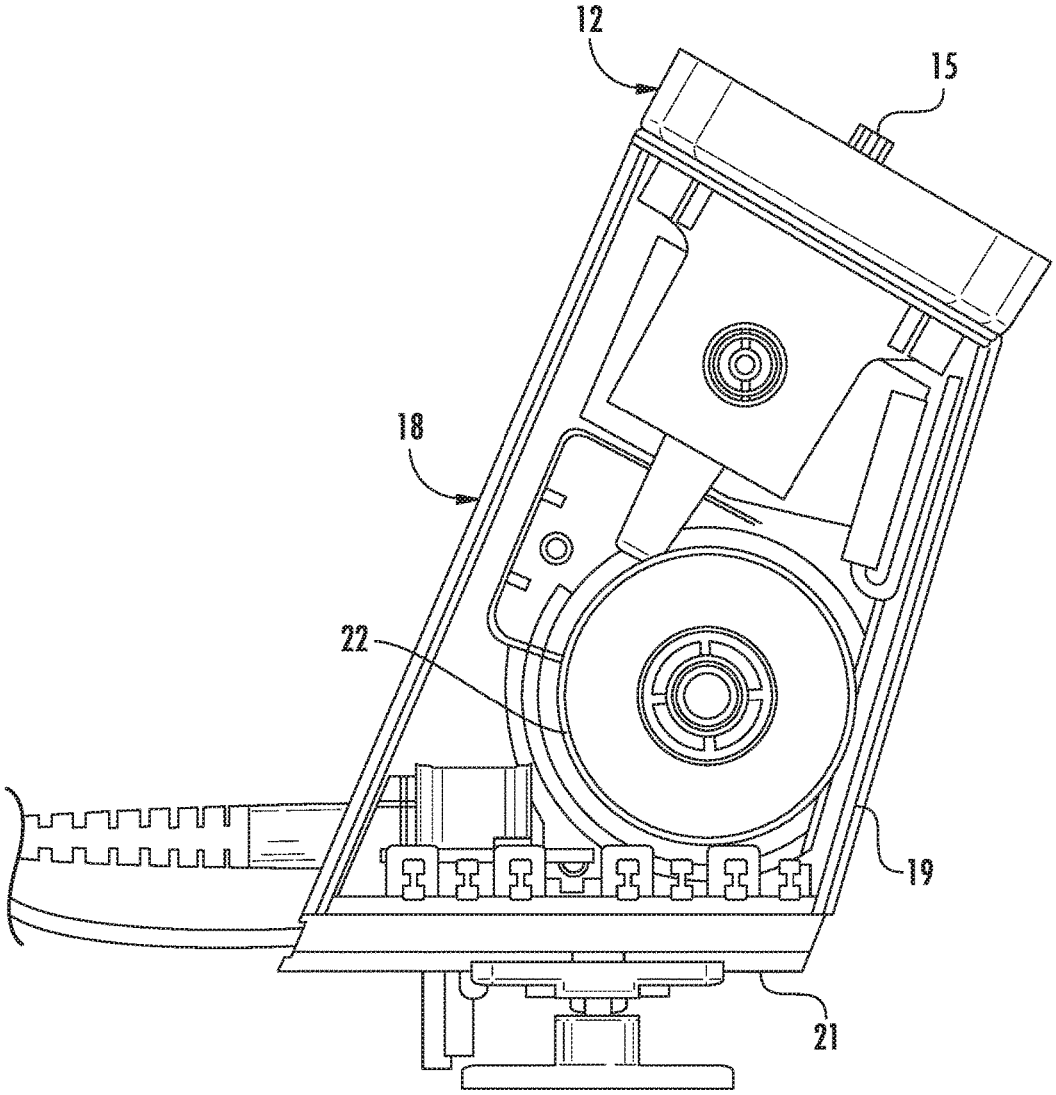
FIG. 2 illustrates a side view of a security system according to one embodiment of the present invention (with a portion of the system being transparent for purposes of illustration).

The sensor 12 may be secured to the item of merchandise 14 using any desired technique, such as an adhesive and/or mechanical brackets. The sensor 12 may have a variety of shapes and sizes for being secured to the item of merchandise 14. In one embodiment shown in FIGS. 2 and 4, the sensor 12 and/or base 18 may include a sensing device 15, such as a pressure or plunger switch, for detecting removal of the item of merchandise 14. In addition, the connector 17 may be configured to be removably inserted into the input jack of the item of merchandise 14. Thus, the sensor 12 and the item of merchandise 14 may be electrically connected via the connector 17. The sensor 12 may include a printed circuit board (PCB), circuitry, or the like. For example, the sensor 12 may include charging circuitry for facilitating power transfer between the base 18 and the item of merchandise 14. The connector 17 may be electrically connected to the PCB using various techniques, such as via an adapter cable 16. In the illustrated embodiment, the connector 17 is mounted to and extends from the sensor 12 via an adapter cable 16 but could be positioned at other locations depending on the location of the input port of the item of merchandise 14. In some cases, the connector 17 may be hardwired to the sensor 12 via the adapter cable 16, although the cable could alternatively include a connector for releasably engaging the sensor.

As noted above, the sensor 12 may include one or more electrical contacts 28. In some embodiments, the sensor 12 includes a plurality of electrical contacts 28. The electrical contacts 28 may be in electrical communication with the PCB in the sensor 12 and the connector 17. Alternatively, the electrical contacts 28 may be electrically connected to only the connector 17. In some embodiments, the sensor 12 may not supply power to the item of merchandise 14 when the item is lifted from the base 18. Rather, the item of merchandise 14 may operate using its own power source when lifted from the base 18.

The base 18 may be configured to be supported by a fixed support or display surface 25, such as a counter, shelf, fixture, or the like. The base 18 may be secured to the support surface 25 using any desired technique such as an adhesive, brackets, and/or fasteners. The base 18 may include one or more magnets or magnetic material, and the sensor 12 may include one or more magnets or magnetic material for releasably holding the sensor on the base. The magnets may aid in aligning the item of merchandise 14 in a desired display orientation. In addition or alternatively, the sensor 12 and the base 18 may include matching geometry for facilitating proper seating of the sensor on the base.

The security system 10 may include a recoiler 22 and a cable 20 as discussed above. The base 18 may include an opening for receiving the cable 20. As such, the cable 20 may be extended through the opening when the sensor 12 and the item of merchandise 14 are lifted from the base, and the cable may be retracted through the opening when the sensor and the item of merchandise are returned to the base. The recoiler 22 may be spring biased in some embodiments such that the cable 20 is automatically retracted within the recoiler. The recoiler 22 may be mounted within the base 18 (see, e.g., FIGS. 1-5), although in other embodiments, the recoiler may be mounted on the underside of the support surface 25. Furthermore, the recoiler 22 may be in electrical communication with the cable 20. In this regard, the cable 20 may include one or more electrical conductors extending along the length of the cable. In some cases, the cable 20 may include a pair of conductors for defining a sense loop or circuit and conducting an electrical signal. In some instances, the cable 20 may be configured to transmit power, security, and/or data signals through one or more conductors extending through the cable 20. For example, the cable 20 may be configured to transmit power in the case where contact charging is not employed. In other cases, the cable 20 may include a single conductor, such as an optical conductor for conducting an optical signal (e.g., a fiber optic cable).

As discussed above, the base 18 may include one or more electrical contacts 40. The contacts 28, 40 of the base 18 and the sensor 12 are configured to align with one another and contact one another when the sensor is supported on the base. Thus, the base 18 and the sensor 12 are in electrical communication with one another when the sensor is supported on the base. The base 18 may be electrically connected to an external power source which is configured to provide power to the base and/or the one or more electrical contacts 40 in the base. The base 18 may also include charging circuitry that is configured to facilitate power transfer from the external power source and the electrical contacts 40. Thus, when the sensor 12 is supported on the base 18, power is able to be transferred between the contacts 28, 40 and to the sensor 12. The connector 17 is electrically connected to the sensor contacts 28 as power is delivered such that power is provided to the item of merchandise 14. Therefore, the item of merchandise 14 may be powered by power transferred thereto and may be used to charge a battery associated with the item of merchandise. In some embodiments, any voltage adaption occurs prior to being delivered to the sensor 12. Voltage adaption may be needed in order to accommodate different items of merchandise 14 that require different operating voltages. Any voltage adaption may occur prior to power being provided to the contacts 28 on the sensor 12. Thus, the sensor 12 and adapter cable 16 do not provide any voltage adaption. However, in other embodiments, the sensor 12 may include a resistor or other identifier that detects the voltage requirements of the item of merchandise 14 which provides a signal to the base 18 for adjusting the voltage as necessary before providing power to the sensor. Although the aforementioned embodiments describe that power may be transferred via contact charging, it is understood that other techniques could be used to transfer power to sensor 12 and the item of merchandise 14. For example, inductive charging functionality could be employed for transferring power, or power may be provided via cable 20 as discussed above.

It is understood that the cable 20 may be any suitable cord, tether, or the like. In addition, the cable 20 may include one or more electrical conductors for transmitting electrical, security, and/or communication signals. In addition, the cable 20 may be a single strand, multi-strand, or braided. The cable 20 may be flexible to facilitate extension and retraction relative to the recoiler 22, and in some embodiments, may be formed of a cut-resistant material. Furthermore, the cable 20 may have various cross sections, such as round or flat. In some embodiments, the security system 10 may not include a recoiler 22. Thus, the cable 20 could be a straight or coiled cable that is coupled to the sensor 12 at one end and electrically connected to a base or an alarm unit at an opposite end.

As shown in FIG. 1, an end of cable 20 may be mechanically and optically connected to the sensor 12. Thus, in this embodiment, the cable 20 is not electrically connected to the sensor 12 in any way, and the conductors in the cable are electrically isolated from the power transmitted to the sensor and the item of merchandise 14. In one embodiment, the sensor 12 may define an opening for receiving an end of the cable 20. In some embodiments, the end of the cable 20 includes an optical transceiver 42 for communicating with the sensor 12 and/or the item of merchandise 14. Likewise, the sensor 12 may include an optical transceiver 42 for communicating with the optical transceiver at the end of the cable 20. The optical transceivers 42 may be used to transmit optical signals in predetermined sequences or patterns and/or in the form of data, as well as receive optical signals and convert the optical signals into electrical signals. In addition, the optical transceivers 42 may be separated by an air gap so as to not be in physical contact with one another and such that the optical transceivers are electrically isolated from one another. The cable 20 may include one or more conductors for providing power to the optical transceiver 42, as well as sending and receiving signals to and from the optical transceiver in the sensor 12. Similarly, the sensor 12 may include a power source that is configured to provide power to the sensor for interpreting signals provided by the optical transceiver 42, as well as power the optical transceiver for sending and receiving optical signals. Furthermore, the end of the cable 20 may be mechanically coupled to the sensor 12 using a variety of techniques and may be configured to rotate or swivel in some embodiments. In one example, the optical transceivers 42 may be configured to rotate relative to one another. Moreover, FIG. 1 shows that the conductors in the cable 20 may be connected to the optical transceiver 42 and a printed circuit board (PCB) or circuitry 44 at one end. Similarly, the connector 17 may include conductors connected to the optical transceiver 42 and a printed circuit board or circuitry 46 in the sensor 12. The end of the cable 20 may include a releasable connector 36 that is configured to contain the optical transceiver 42 and PCB 44. The connector 36 may also contain a crimp 48 or other like device for securing the ends of the conductors in the cable 20 together. The connector 36 may be configured to mechanically engage a cooperating connector on the sensor 12 (see, e.g., FIG. 5). FIG. 1 further shows that an opposite end of the cable 20 may be electrically connected to a slip ring 34 for allowing electrical and other signals to be communicated between the conductors in the cable and any conductors electrically connected to the recoiler 22.

Figure 3:
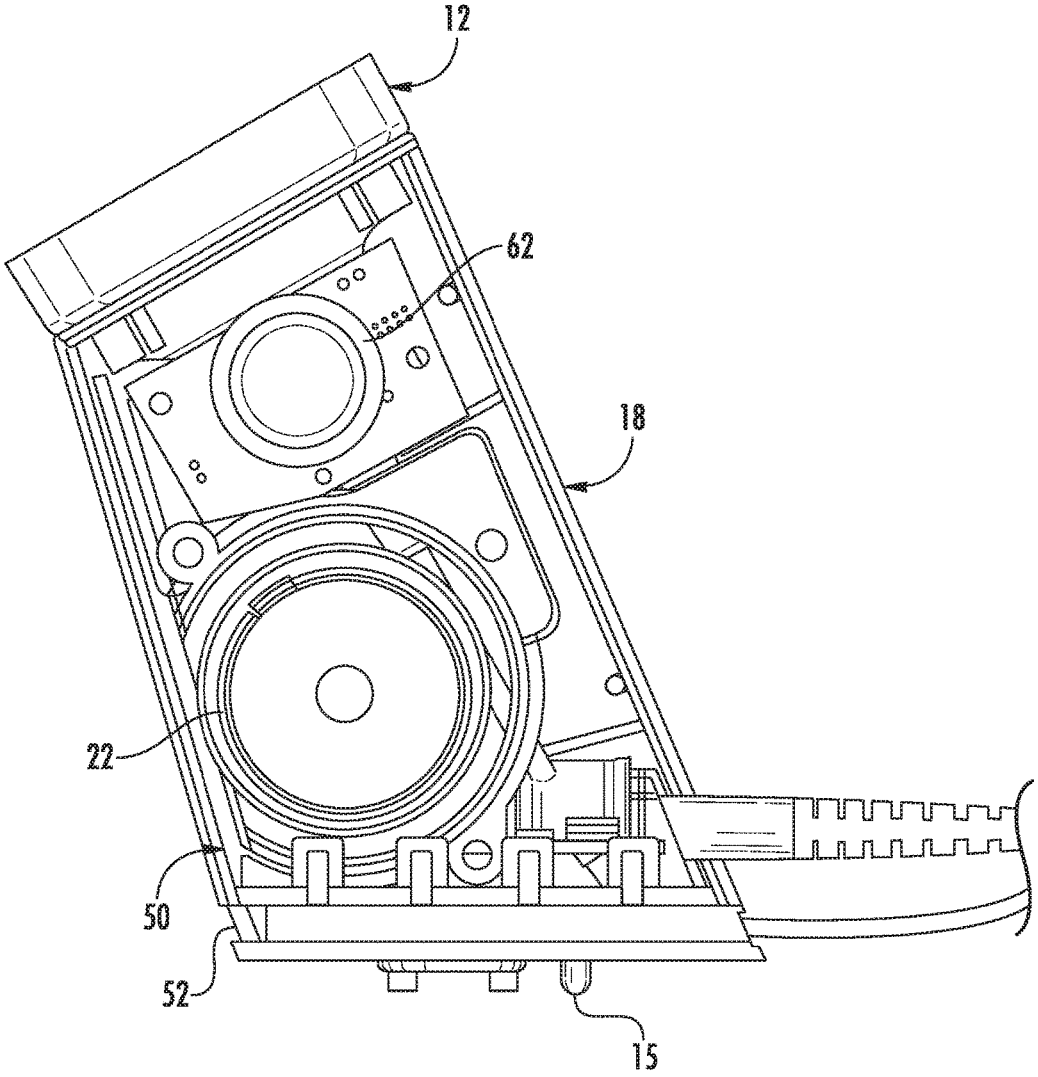
FIG. 3 illustrates another side view of the security system shown in FIG. 2.
Figure 4:
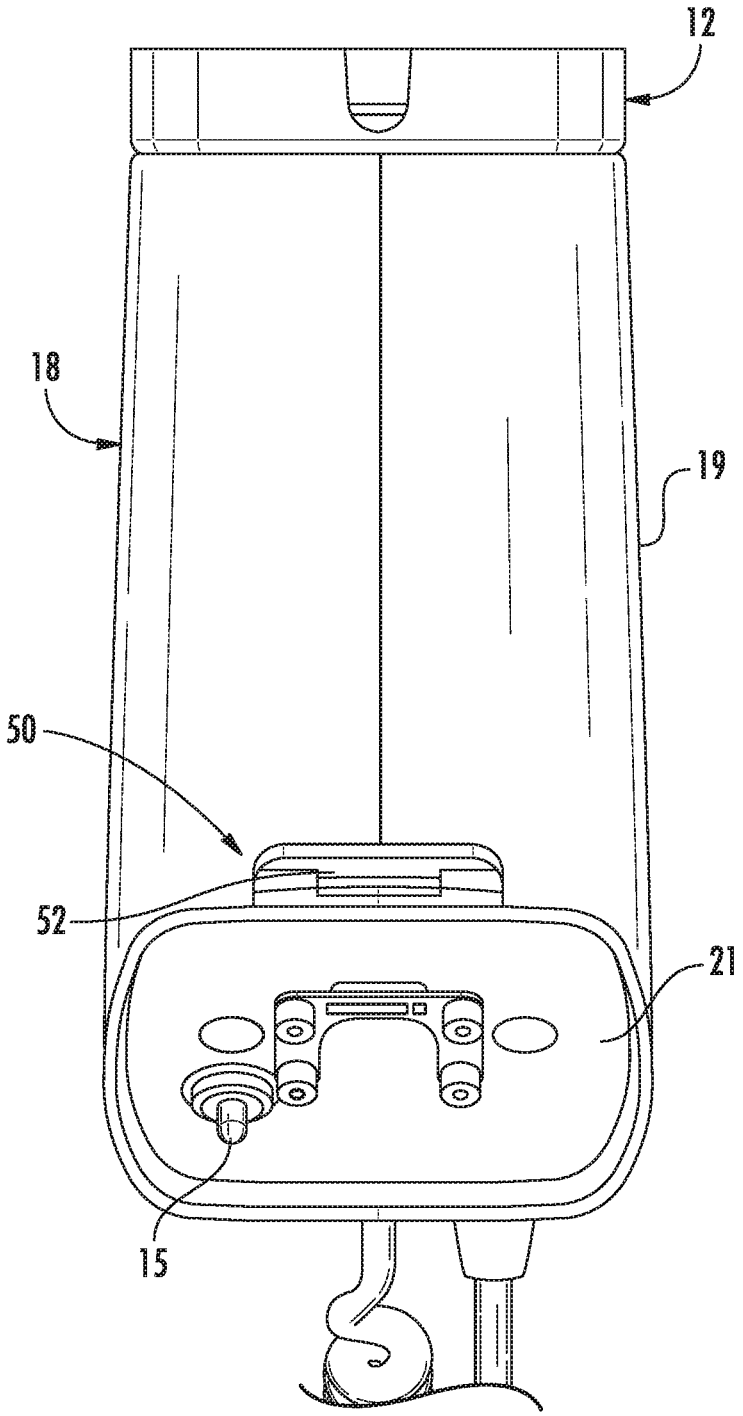
FIG. 4 illustrates a front view of the security system shown in FIG. 2.
Figure 5:
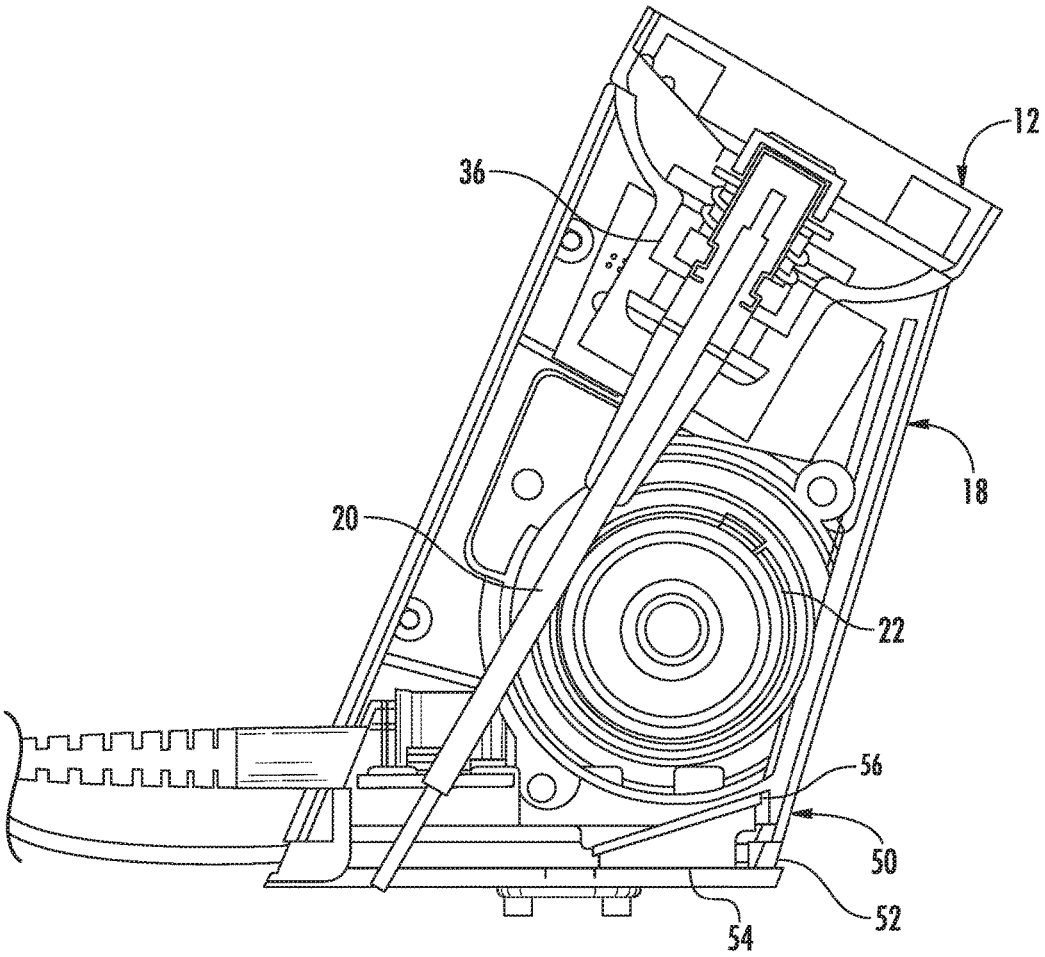
FIG. 5 illustrates a cross-sectional view of the security system shown in FIG. 2.

The optical transceivers 42 may be used to define a sense loop and detect various security events, such as when the cable 20 is cut or removed from the sensor 12 and/or the connector 17 is removed from item of merchandise 14 in an unauthorized manner. It is understood that various types of sensing techniques may be used for detecting when the cable 20 is attached or detached from the sensor 12 and/or item of merchandise 14, as well as when the connector 17 is removed from the item of merchandise. For example, the optical transceiver 42 at the end of the cable 20 may communicate an optical signal to the optical transceiver in the sensor 12 where the sensor can determine that the item of merchandise 14 and the cable 20 are secure. The optical transceiver in the sensor 12 may then communicate an optical signal to the optical transceiver at the end of the cable 20 to indicate that the item of merchandise 14 is secure. Should the optical signals be interrupted or an unexpected optical signal is received, the base 18 or other alarm unit may detect the interruption and generate an alarm signal. For example, the base 18 or other alarm unit may be configured to generate an audible and/or a visible alarm. In one embodiment, FIGS. 3-5 show that the base 18 may include an alarm 50, such as a piezoelectric device, for generating an audible alarm. The sensor 12 may likewise include an alarm for generating an audible and/or a visible alarm. The base 18 may be configured to be armed and/or disarmed via a key, such as a wireless key. For instance, FIG. 3 shows that the base 18 may include a port 62 for facilitating communication with a key.

It is understood that various sensing techniques may be utilized. For example, as an alternative to optical transceivers, the cable 20 may include one or more conductors for transmitting and receiving signals for defining a sense loop. In this instance, the cable 20 and sensor 12 may be electrically connected when the cable 20 is connected to the sensor.

Figure 6:
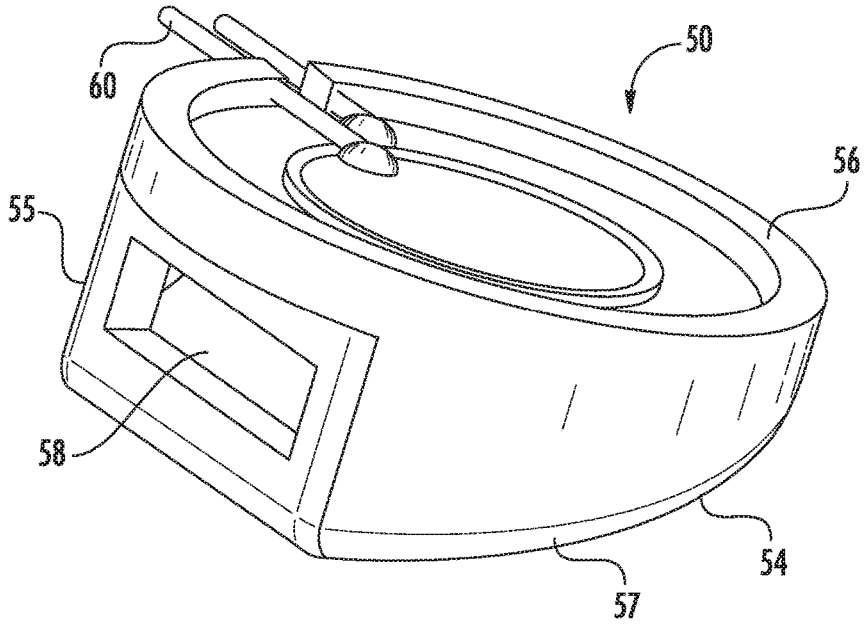
FIG. 6 illustrates a perspective view of an alarm according to one embodiment of the present invention.

As referenced to above, the base 18 may include an alarm 50. Embodiments of the present invention provide enhancements to conventional alarming devices as explained in further detail below. FIGS. 3-5 show an embodiment of an alarm 50. In this example, the base 18 defines an opening 52 for transmitting sound generated by the alarm 50. The opening 52 may be defined through a sidewall 19 of the base 18 rather than through a bottom surface 21 of the base. The opening 52 is shown as being defined on a front surface of the base 18, although it is understood that the opening may be located at any desired location relative to the alarm, and that any number of openings may be used. FIG. 5 shows that the alarm 50 includes a sound chamber defined by a chamber 54 and a cap 56. The cap 56 may be in the form of a piezoelectric element that is configured to resonate or vibrate in response to an electronic signal. For example, the cap 56 may be formed of one or more metals and be configured to receive an input voltage (e.g., about 5 volts) via conductors 60. The cap 56 may be various shapes such as circular. In addition, the cap 56 may be configured to resonate at a desired frequency. For example, a cap 56 having a diameter of about 20 mm may resonate at about 3-4 kHz, while a cap having a diameter of about 15 mm may resonate at about 4-5 kHz. The vibrations generated by the cap 56 create sound that is formed within the chamber 54 and exits through an opening 58 defined in the chamber (see, e.g., FIG. 6-7). Where the chamber 54 includes a sidewall 55 and a bottom surface 57, the opening 58 may be defined in the sidewall. The opening 58 defined in the chamber 54 may correspond to the opening 52 defined in the base so that sound exiting the opening 58 is directed out of the opening 52. For instance, the opening 58 may be positioned adjacent or in close proximity to the opening 52. The size and shape of the opening 58 may be varied for tuning the sound exiting the chamber 54. In the illustrated embodiment, the opening 58 is rectangular in shape, although other shapes are possible, such as oval or circular.

Figure 7:
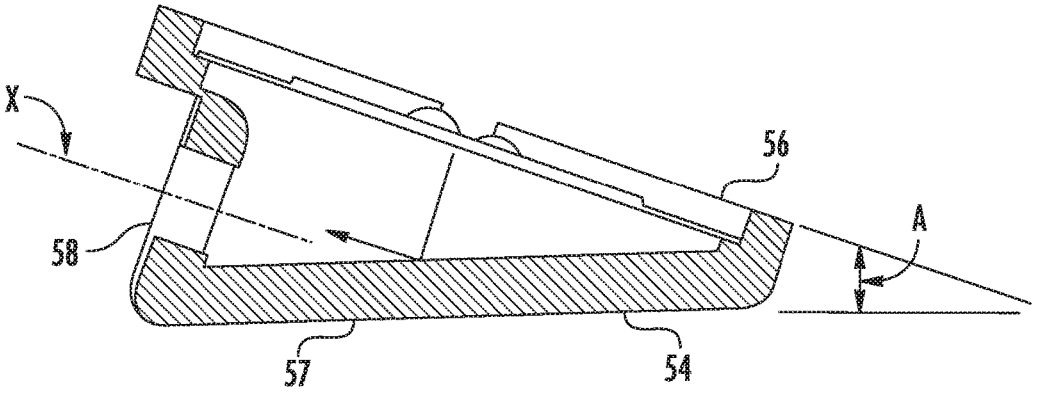
FIG. 7 illustrates a cross-sectional view of the alarm shown in FIG. 6.

As shown in FIG. 7, the cap 56 may be disposed at an angle "A" relative to a bottom surface 57 or plane of the chamber 54. In this way, the alarm 50 may be wedge shaped. In some cases, the center axis "X" of the opening 58 may be parallel or generally parallel (e.g., within $^{+/-}3$ degrees of parallel) to the surface or plane of the cap 56. In one embodiment, FIG. 7 shows that at least some of the sound generated via the cap 56 may be directed downwardly and deflected off of the bottom surface 57 of the chamber 54 towards the opening 58. In one example, the sound is deflected at about 90 degrees. It is understood that various desired angles A may be used (e.g., about 15-20 degrees) and chamber 54 sizes for generating different sound levels. In some cases, the angle A is acute or some angle less than about 90 degrees. Moreover, although the alarm 50 is shown as being housed within the base 18, it is understood that the alarm could be located within the sensor or remotely from the base. In addition, any number of alarms 50 could be utilized, such as an alarm in the base 18 and an alarm in the sensor 12.

Figure 8:
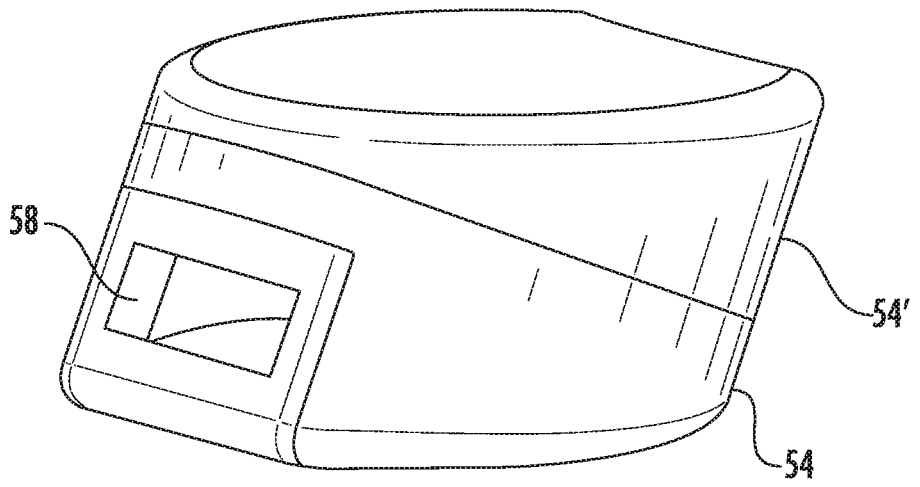
FIG. 8 illustrates a perspective view of an alarm according to another embodiment of the present invention.
Figure 9:
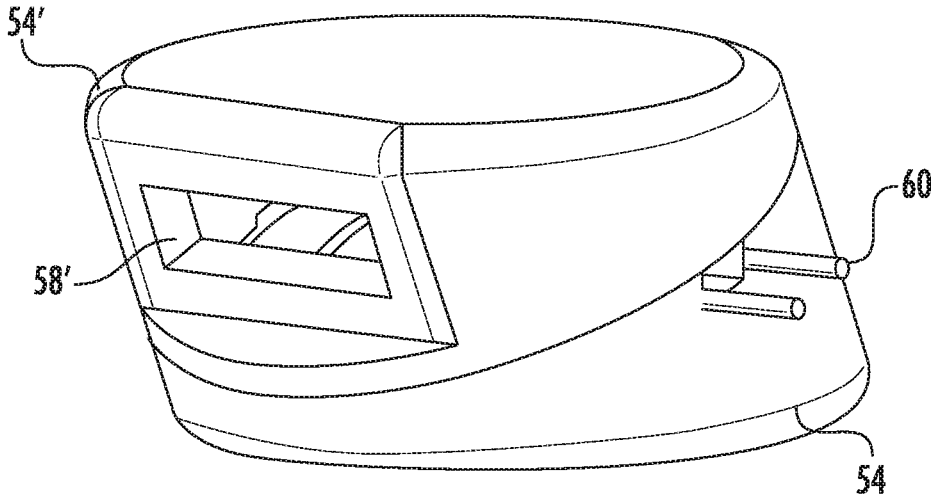
FIG. 9 illustrates another perspective view of the alarm shown in FIG. 8.
Figure 10:
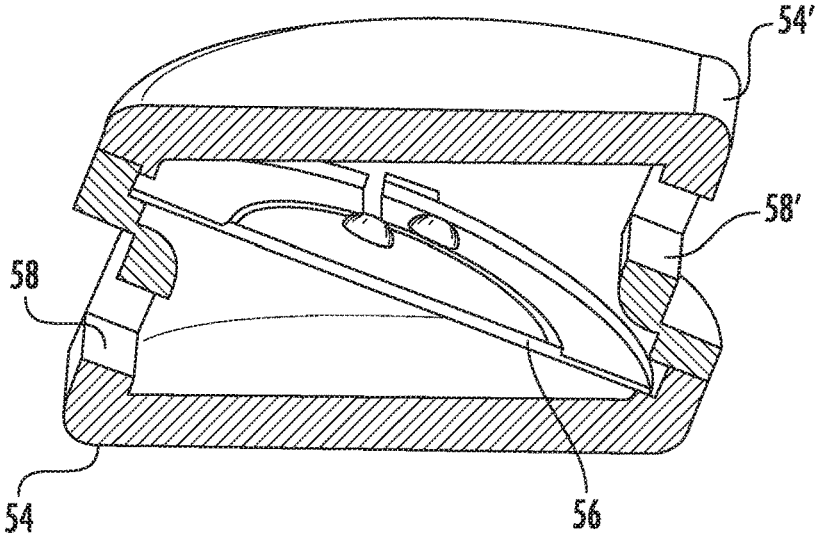
FIG. 10 is a cross-sectional view of the alarm shown in FIG. 8.

FIGS. 8-10 illustrate another embodiment of an alarm 50 including a double chamber. In this embodiment, the alarm 50 includes a second chamber 54' and opening 58'. As shown, the cap 56 is disposed between the chambers 54, 54' such that the cap extends at an angle relative to both chambers. In this way, sound generated by the cap 56 is directed into each chamber 54, 54' and out of a respective opening 58, 58'. Thus, the double chamber allows for utilization of a single cap 56 with two chambers 54 and thereby directing sound in two opposite directions thereby further enhancing the sound generation by the alarm. Although the chambers 54, 54' are shown as having the same size or volume, it is understood that the size and volume may be modified relative to one of the chambers such that they differ.

Figure 11:
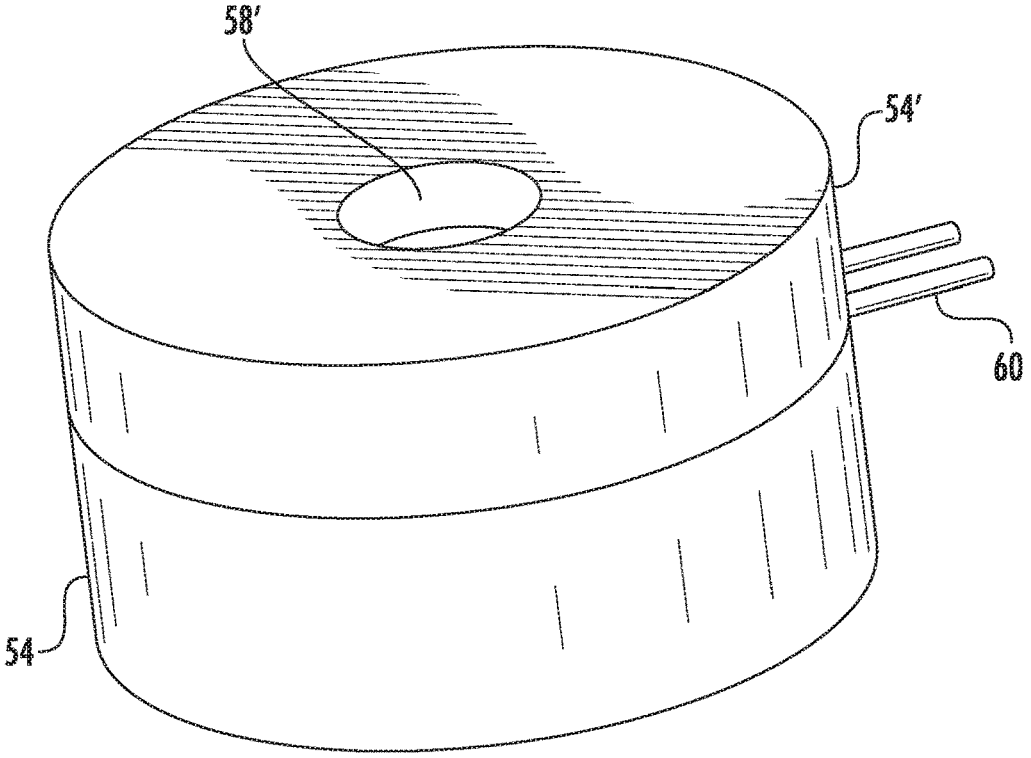
FIG. 11 illustrates a perspective view of an alarm according to another embodiment of the present invention.
Figure 12:
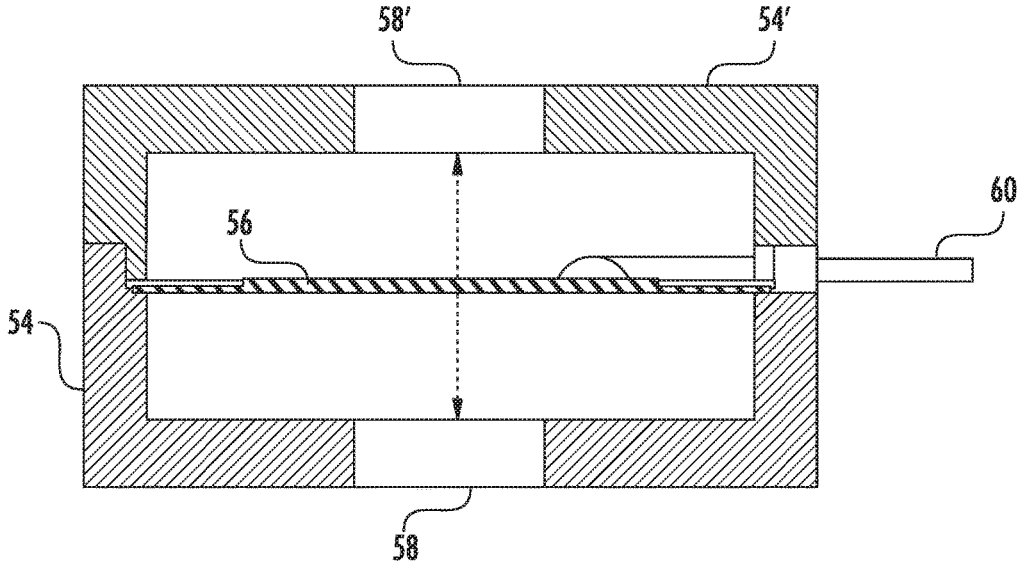
FIG. 12 illustrates a cross-sectional view of the alarm shown in FIG. 11.
Figure 13:
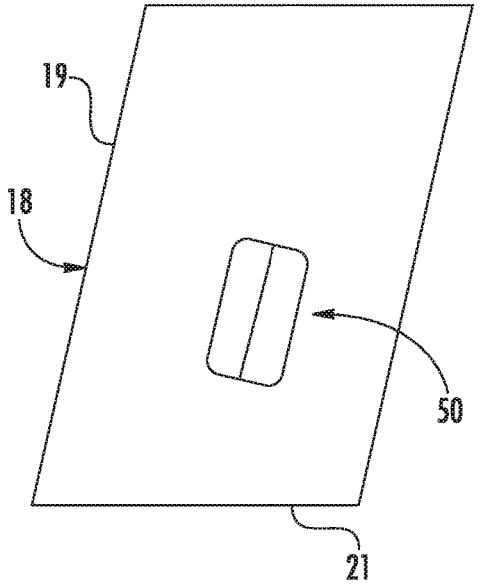
FIG. 13 illustrates a schematic of a security system according to one embodiment of the present invention.

Furthermore, FIGS. 11-12 show another embodiment of an alarm 50 including a double chamber. In this embodiment, the cap 56 is disposed parallel to each of the chambers 54, 54'. In this case, sound generated by the cap 56 is directed out of respective openings 58, 58' defined in a respective chamber 54, 54'. As shown, the cap 56 may extend parallel or generally parallel to the top surface or plane of each chamber 54, 54'. The center axes of the openings 58, 58 may be parallel or generally parallel (e.g., within $^{+/-}3$ degrees to parallel) to one another. Thus, at least some sound generated by the cap 56 may be directed parallel or generally parallel to the center axis of each opening 58, 58'. In this embodiment, the cap 56 could be oriented vertically or generally vertically (e.g., within $^{+/-}3$ degrees of vertical) within the base 18 such that the openings 58, 58' are directed laterally outward through the base. Alternatively, the cap 56 could be oriented parallel or generally parallel (e.g., within $^{+/-}3$ degrees) to a front and/or rear surface of the base 18 such that sound is directed outwardly generally perpendicular to an opening 52 defined in the front and/or rear surface (see, e.g., FIG. 13). It is understood that one of the chambers 54, 54' may be eliminated in some cases, similarly to that shown in the embodiment of FIGS. 6-7.

Therefore, embodiments of the present invention may provide several advantages. In this regard, conventional alarms utilize piezoelectric elements that do not effectively transmit sound from within an enclosure. For instance, many conventional alarms direct sound downwardly towards the bottom of the base and the support surface such that much of the sound is absorbed or reflected within the base and the support surface prior to exiting the base and thus is not efficiently used. In contrast, embodiments of the present invention facilitate a more direct path for the sound to exit the base for enhancing the sound level. For instance, testing has shown that embodiments of the present invention generate over a 5 dB increase in sound relative to a conventional alarm and base. In addition, embodiments of the alarms allow for more effective use of space within the base, particularly when space is limited. In this regard, the angled cap provides for an alternative when the cap cannot be oriented vertically within the base.

The foregoing has described one or more embodiments of security systems for securing an item of merchandise from theft or unauthorized removal. Although various embodiments of the present invention have been shown and described, it will be apparent to those skilled in the art that various modifications thereto can be made without departing from the spirit and scope of the invention. Accordingly, the foregoing description is provided for the purpose of illustration only, and not for the purpose of limitation.

That which is claimed is:

1. A security system for securing an item of merchandise from theft or unauthorized removal, the security system comprising:

a base configured to removably support the item of merchandise thereon, the base comprising an opening; and an alarm configured to generate sound in response to a security event and direct the sound out of the opening in the base, the alarm comprising a sound chamber, wherein the sound chamber comprises a cap coupled to a chamber and an opening defined in the chamber for allowing sound to exit the chamber, wherein the cap is disposed at an angle relative to a bottom surface of the chamber, and wherein the cap is configured to resonate for generating sound, and wherein the chamber is configured to direct the sound towards the bottom surface of the chamber in a first direction and out of the opening of the chamber in a second direction that is different than the first direction.

2. The security system of claim 1, further comprising a sensor configured to be coupled to the item of merchandise.

3. The security system of claim 2, further comprising a cable connected to the sensor and the base and configured to define a sense loop.

4. The security system of claim 2, wherein the alarm is operably engaged with the cable and is configured to generate an alarm signal when the item of merchandise is removed from the sensor or the sense loop is interrupted.

5. The security system of claim 2, further comprising a cable connected to the sensor, wherein each of the sensor and an end of the cable comprises an optical transceiver, and wherein the optical transceivers are configured to communicate optical signals with one another to detect removal of the sensor from the cable.

6. The security system of claim 5, wherein the alarm is configured to generate an audible alarm in response to an interruption of the optical signals.

7. The security system of claim 1, wherein the alarm is wedge shaped.

8. The security system of claim 1, wherein the cap is disposed at an acute angle relative to the bottom surface of the chamber.

9. The security system of claim 1, wherein the cap is disposed parallel or generally parallel to a center axis of the opening defined in the chamber.

10. The security system of claim 1, wherein the base comprises a sidewall and a bottom surface, and wherein the opening in the base is defined in the sidewall thereof.

11. The security system of claim 10, wherein the chamber does not direct sound exiting the opening of the chamber towards the bottom surface of the base.

12. The security system of claim 1, wherein the cap comprises a piezo element.

13. The security system of claim 1, wherein the cap has a diameter of about 20 mm.

14. The security system of claim 1, wherein the cap is circular in shape.

15. The security system of claim 1, wherein the cap is disposed at an angle of about 15-20 degrees relative to the bottom surface of the chamber.

16. The security system of claim 1, wherein the alarm is housed within the base.

17. The security system of claim 1, wherein the first direction and the second direction define an angle of about 90 degrees therebetween.

18. The security system of claim 1, wherein the sound directed in the first direction is configured to be deflected within the chamber to the second direction.

19. A method for securing an item of merchandise from theft or unauthorized removal, the method comprising:

generating sound with a sound chamber in response to a security event, wherein the sound chamber comprises a cap coupled to a chamber and an opening defined in the chamber for allowing sound to exit the chamber, wherein the cap is configured to resonate for generating sound;

directing the sound in a first direction towards a bottom surface of the chamber; and directing the sound in a second direction with the chamber that is different than the first direction out of the opening of the chamber and towards an opening defined in a base housing the sound chamber.

20. The method of claim 19, wherein directing the sound in the second direction does not comprise directing the sound towards a bottom surface of the base.

* * * * *